US006582319B2

(12) United States Patent
Czaja

(10) Patent No.: US 6,582,319 B2
(45) Date of Patent: Jun. 24, 2003

(54) GOLF SWING TRAINING APPARATUS

(75) Inventor: David Czaja, Norwalk, CT (US)

(73) Assignee: Katema LLC, Hartsdale, NY (US)

( * ) Notice: Subject to any disclaimer, the term of this patent is extended or adjusted under 35 U.S.C. 154(b) by 0 days.

(21) Appl. No.: 09/745,504

(22) Filed: Dec. 22, 2000

(65) Prior Publication Data

US 2002/0082106 A1 Jun. 27, 2002

Related U.S. Application Data

(63) Continuation of application No. 09/358,093, filed on Jul. 21, 1999, now Pat. No. 6,165,079.

(60) Provisional application No. 60/249,740, filed on Nov. 17, 2000.

(51) Int. Cl.[7] ..... A63B 69/36

(52) U.S. Cl. ..... 473/257; 473/258; 473/264

(58) Field of Search ..... 473/219, 251, 473/261, 262, 263, 264, 265, 257, 258, 259; 434/247, 252

(56) References Cited

U.S. PATENT DOCUMENTS

| | | | | | |
|---|---|---|---|---|---|
| 2,520,287 | A | * | 8/1950 | Plunkett et al. | 473/259 |
| 3,339,927 | A | * | 9/1967 | Nunn | 248/455 |
| 3,489,416 | A | * | 1/1970 | Mark | 473/229 |
| 4,583,740 | A | * | 4/1986 | Ohly | 473/259 |
| 4,634,131 | A | * | 1/1987 | Vella et al. | 473/229 |
| 4,815,743 | A | * | 3/1989 | Meeker et al. | 473/257 |
| 5,332,211 | A | * | 7/1994 | Rife et al. | 273/DIG. 21 |
| 5,409,231 | A | * | 4/1995 | Kueng et al. | 473/157 |
| 5,586,945 | A | * | 12/1996 | Vonderhaar | 473/258 |

* cited by examiner

*Primary Examiner*—Kien T. Nguyen
(74) *Attorney, Agent, or Firm*—Carter Ledyard & Milburn LLP; John M. Johnson; Jack F. Cahill

(57) ABSTRACT

A golf training device for chipping or pitching comprises a vertical support means; an arcuate rigid planar sheet having upper, leading, trailing, and lower edge portions describing an arc of approximately 120°; and an adjusting means engaging said sheet and holding said sheet in a predetermined angular relation with said vertical support means; whereby the golfer may swing the clubhead of a golf club along the inner planar surface of said sheet.

2 Claims, 7 Drawing Sheets

FIG. 8
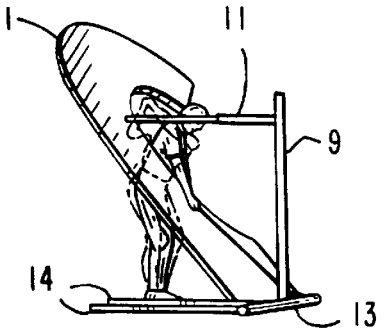
FIG. 9
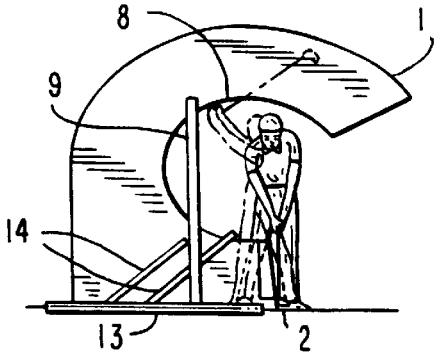
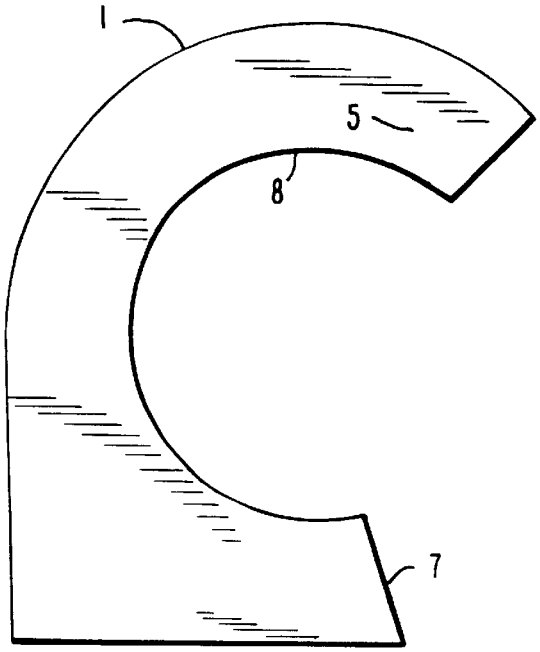
FIG. 10
FIG. 11
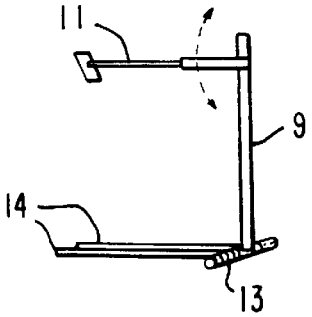
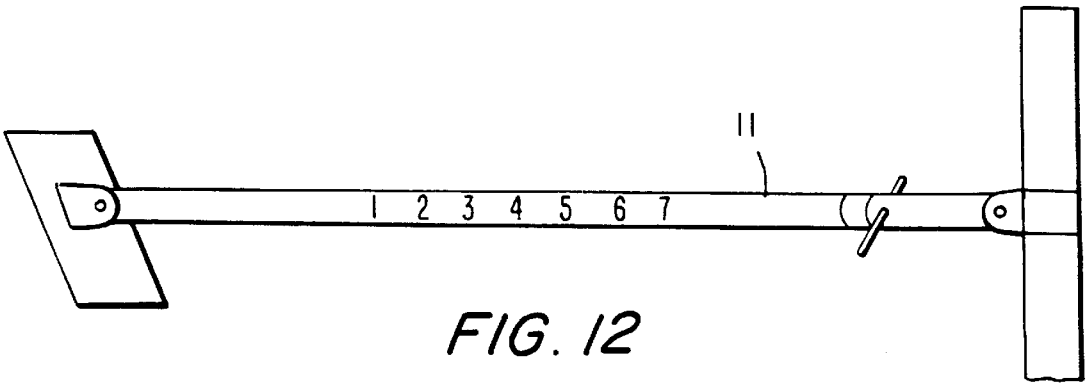
FIG. 12

FIG. 18A
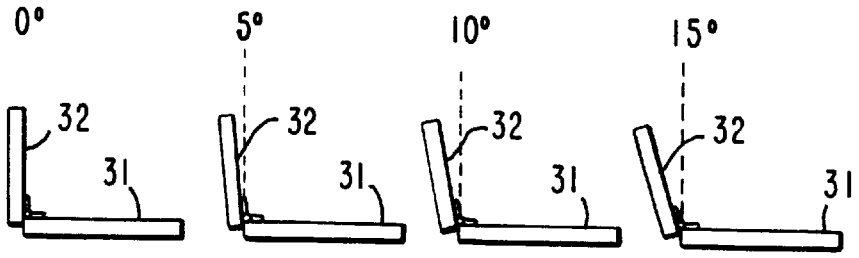
FIG. 18B
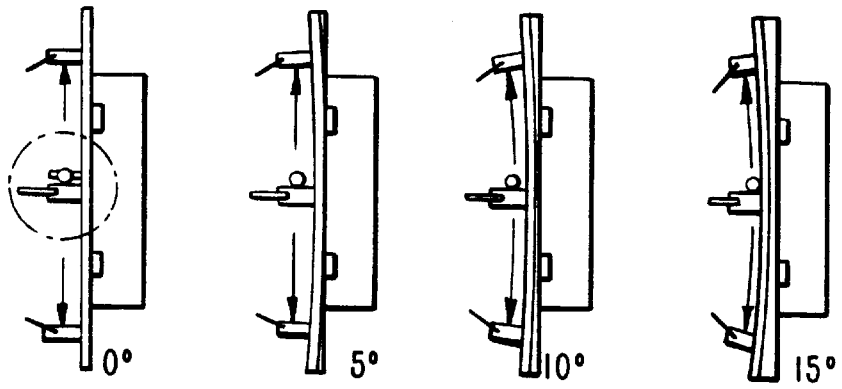
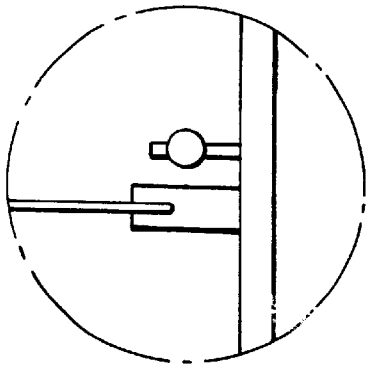
FIG. 18C

FIG. 20
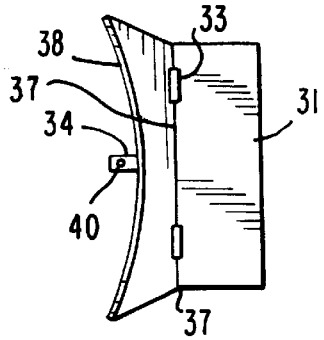
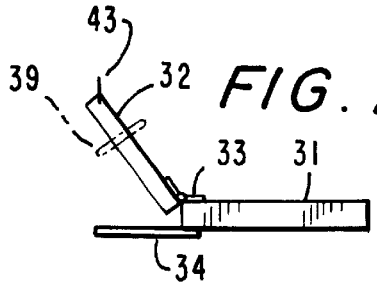
FIG. 21
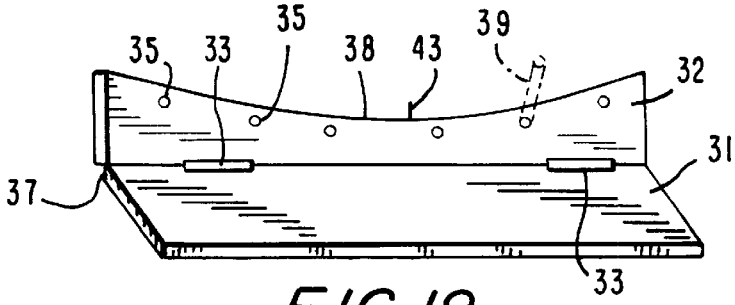
FIG. 19
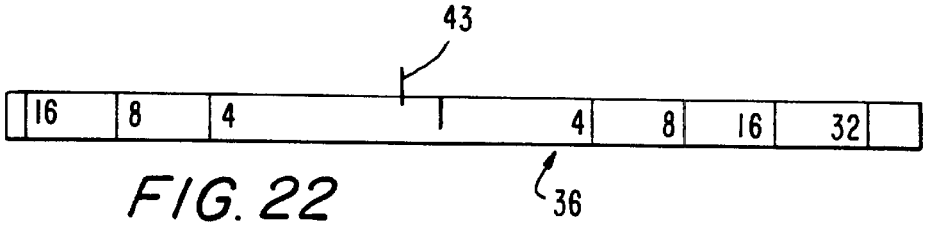
FIG. 22
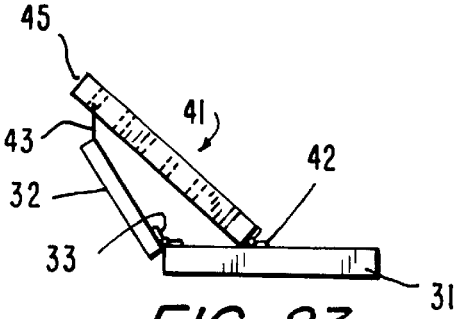
FIG. 23
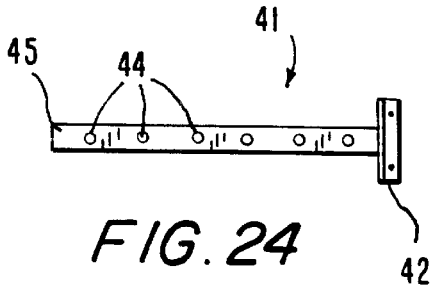
FIG. 24

GOLF SWING TRAINING APPARATUS

This application is a continuation of U.S. application Ser. No. 09/358,093, now U.S. Pat. No. 6,165,079, which was filed Jul. 21, 1999 and which also claims benefit to U.S. Provisional Application S. No. 60/249,740 filed Nov. 17, 2000.

BACKGROUND OF THE INVENTION

The literature of golf instruction is replete with advice and observations on the dynamics of a proper swing. It includes theories regarding "swing plane" as it relates to the "clubshaft" or "clubhead" as they are swung in certain directions and relationships to the golfer's body. The specific movements which the body should make in order to carry out the desired motions of striking a golf ball accurately have been written about in detail, and many other elements and theories of the swing itself have been examined since the beginning of the game of golf.

Golfers and golf professionals have worked ceaselessly in training and in an effort to "groove" the swing so as to produce a flight of the ball, which is straight and long.

Many devices have been created for training golfers to reproduce a proper golf swing. Complicated and misleading devices based in theory have hurt more golfers than they have helped. Devices designed to "track" the "shaft" of the golf club have been developed, and proven to be less than totally effective. It has been proven also that any device which attempts to "guide" the golf club on a "plane" parallel to that of the clubshaft at address does not accurately replicate what is being done by the world's greatest players and ball-strikers, and would thus be misleading or detrimental. It has been established and proven that the only accurate "swing plane" the golf club can be swung on, to accurately replicate a "professional motion", must be one which is determined by the arc of the clubhead swinging in contact, and on the underside of a flat plane. This plane must also be inclined from the toe of the club at address through the top of the spine at the base of the golfer's neck. There are also devices designed to "guide", or "track" the golfer's hands on a "plane", but these too tend to be somewhat inaccurate and somewhat misleading to the golfer, since they utilize an incorrect plane, or rather a plane parallel to the shaft at address; see, for example, U.S. Pat. No. 4,815,743 (Meeker). It is to improved and accurate swing training apparatus for full swings, chipping, and putting that the present invention is directed.

Previously proposed and patented practice devices are either incapable of accurately allowing the golfer to experience, with their own equipment, the feeling of properly swinging their clubs on their "ideal planes", because the "plane" is defined with these earlier devices by clubshaft guides, or they are misleading and restricting the golfer by using rails or grooves for the clubhead to swing in or on. As an example, U.S. Pat. No. 3,489,416 (Mark) discloses a practice device for "grooving" an inside-out swing. Mark incorrectly assumes that the "proper golf swing is identical for all clubs (excepting the putter)" (page 1, line 54). This is not the case for a "professional motion", and discounts the individual mannerisms of the professional as the clubhead arcs of professional golfers have been proven to shift in width different distances on the downswing. Also, modern golf theory does not "postulate the use of an 'inside-out' golf swing giving rise to the plural swing planes" (page 1, line 68), but rather computer analysis of the clubhead of the world's leading ball-strikers proves, quite the contrary, that a single plane concept is being utilized. As another example, U.S. Pat. No. 4,815,743 (Meeker) discloses a practice device as "a guide for assisting a golfer to learn the feel of the body positions for carrying out a properly executed golf club swing." The planar undersurface of this device immediately "overlies the plane of movement of the golfer's hands" but fails to take into account the most critical element of the swing, which is the plane of the clubhead. Meeker also incorrectly assumes that body positions are more important than the path or plane of the clubhead (page 1, lines 19–25). "While devices as shown and described in these earlier patents are of limited use for demonstrating to the golfer the path which a golf club should generally follow during the swing, they are not very effective in insuring that the golfer maintains optimum body positions during practice so that the golfer is likely to execute the swing properly when the aid is no longer used." It is readily apparent in the actions of the world's best players that although their body actions are very unique and individual, the true common denominator in the excellence of their ball-striking lies in the geometry of the aiming, and the inclination of the plane of their clubheads. To fix rails or tracks which would guide the arcs of the golfer's clubhead as shown in U.S. Pat. No. 3,489,416 (Mark) would likewise restrict the most efficient application of power by not allowing the arcs to shift properly. Although certain earlier devices may appear similar at first glance to the devices of the present invention, they are all quite different. For example, Meeker U.S. Pat. No. 4,815,743 discloses a device the purpose of which is to guide the golfer's hands in executing the swing. This device is designed with (page 2, line 49) "the arc or edge 34 is generally concentric to the path of movement of the golfer's hands in swinging the club through the desired swing." The purpose of this device is to establish a planar surface (claim 1, line 60, page 5) "to carry out said swing with the golfer's hands guided for movement throughout said swing by said overlying undersurface of said member." In contrast, the present invention is designed to provide a planar surface to guide the golfer's clubhead, rather than the golfer's hands, through the correct plane of motion. The Mark U.S. Pat. No. 3,489,416 discloses that the purpose of the earlier device is to provide a tracking mechanism for "guiding the golf club through an inside out or 'grooved' swing" (line 12, abstract). The training device of the present invention provides a planar surface along which the toe or front portion of the golf club (be it a driver, iron, or putter) is addressed and swung along the underside. the Mark U.S. Pat. No. 3,489, 416 provides a backswing track which in (page 5, line 12) "mounted in raised relation relative to the track platform 16 by a number of columnar supporting members 27 which are substantially equal length." It is clearly apparent in his FIGS. 4, 5, 9, 10, and 11 that he has established a planar surface, which the heel of the golf club is to be swung above and on top of.

The present invention is intended to provide a planar surface for the golfer to swing his own club on the underside of the plane, with no tracks, guides, or need for a special training club, which clearly distinguishes it from the foregoing prior art devices. The present invention provides a training device based on a "singular plane concept", the purpose of which is to give the golfer an awareness of what the world's best ball-strikers are achieving when they swing on one plane, rather than a dual plane "inside-out" concept as disclosed by U.S. Pat. No. 3,489,416 (Mark).

The U.S. Pat. No. 1,854,392 (Bambrich) discloses a practice device which consists of a (page 1, line 20) "curved rail against the under edge of which the shaft of the golf club may slide"; also (page 1, line 63) "may swing a golf club with the shaft thereof in contact with the lower edge of rail 10". Such a device cannot guarantee that the clubhead would be swung within the same plane of motion achieved by use of the present invention. It has been established and proven through research of professional golfers that only the clubhead is swung on a single plane. Any attempt to force the club shaft onto a single plane of motion would not guarantee that the correct plane was also being achieved by the clubhead and would not mimic the action of a professional motion. One purpose of the present invention is to provide a planar surface for the head of the golf club to remain in contact with rather than that of the club shaft.

SUMMARY OF THE INVENTION

It has been proven through computer analysis of the world's best players and ball-strikers that a well executed golf swing requires the head of the golf club, and not the shaft of the club or the hands to be swung through a single "plane" of motion on the backswing. This "plane" has been proven to be inclined at a precise relationship to the golfer's body and clubshaft at address. Analysis of a computer model of the world's greatest ball-strikers has proven this theory. Such a model is shown in Ralph Mann & Fred Griffin's instructional book "Swing Like a Pro", 1999. Although the head of the golf club can be "tracked" on many different planes on the backswing, it has been proven that there is indeed an "ideal plane" of motion which these exceptional players achieve. References to this "plane" are also documented in Carl Lohren's instructional book "One Move to Better Golf" pages 46–51, and Dave Pelz's "Short Game Bible" pages 74–77.

The new and improved apparatus of the present invention provides a "swing plane surface" for the clubhead to be swung in contact with, rather than for the clubshaft or for the hands. No rails, guides, or tracks are provided, but rather a predetermined amount of surface area sufficient to accommodate golfers of all sizes and club shaft lengths of all sizes is available for the golfer's club to engage during the swing or stroke. This guide surface area has been carefully and precisely replicated in the apparatus of the present invention to insure that golfers of all heights and builds will be able to swing any club from driver to putter while being able to maintain contact with the planar guide surface of the invention when the swing is executed properly.

This "swing plane surface" may have a ten degree foam wedge affixed vertically to its lower leading edge to ensure the golfer has achieved the ideal hand and shaft position at address, which has been proven through analysis of model swings to be a common denominator of great ball-strikers. This foam "wedge" is also affixed to help determine the "ideal plane angle setting" for the surface. The swing plane surface is in a "c" shape, with minor exceptions at its base for stability. It has portions removed at the leading edge so that the golfer's left arm and shoulder (for right-handed golfers) are free to swing while the clubhead is swung underneath but in contact with the available surface area.

The "swing plane surface" may be fabricated from any rigid material such as plywood, Plexiglass, or other plastic sheet or molded material, solid or perforated to reduce wind resistance; alternatively, it may comprise a skeletal frame to which a strong inelastic coated fabric or inelastic plastic sheet material is secured to establish a lightweight surface. It is possible that a conductive rubber surface may be adhered to the planar surface to give auditory feedback to the golfer when the golf clubhead is engaged. The support for the "swing plane surface" may be a vertical post having an adjustable length guide wire(s), or chain(s) to secure the "swing plane surface" in a desired "ideal" canted relationship to the ground, the golfer's clubshaft, and the golfer. Also, a telescopic mechanism may be attached to the vertical support post to achieve the same end. A base structure is employed consisting of a vertical post attached to horizontal piping, which lies on the ground. Horizontal support legs are spaced out and run through holes on the "plane surface", proceeding to the underside where the golfer is standing, and are also on the ground. Possible support structures would include a rear support mechanism anchoring the "swing plane surface" to a telescopic post fixed to a rectangular base, and/or platform surrounding the apparatus.

For better appreciation of the invention, reference should be made to the accompanying drawings taken in conjunction with the following detailed description for a right-handed golfer. For a left-handed golfer, a mirror image of the apparatus is contemplated.

BRIEF DESCRIPTION OF THE DRAWINGS

FIG. 8 is a side elevational view of apparatus and golfer in set up and top of swing positions;

FIG. 9 is a front elevational view of golfer in set up and top of swing positions;

FIG. 10 is a drawing showing the dimensions and shape of an alternate preferred embodiment of the swing plane surface;

FIG. 11 is a drawing of the supporting structure for the planar surface consisting of a vertical pole attached to a horizontal pole with two supporting legs on the ground going through the plane;

FIG. 12 shows a telescopic mechanism for adjusting plane angles attached from the vertical pole to the planar surface;

FIG. 18 is a schematic of a putting training device in accordance with the principles of the invention;

FIG. 19 is a front elevational view of a putting training device in accordance with the principles of the invention;

FIG. 20 is a plan view of the apparatus of FIG. 19;

FIG. 21 is a side elevational view;

FIG. 22 is a view of the edge of the inclined putting guide plane;

FIG. 23 is a side view of the adjusting mechanism of the apparatus of FIG. 19;

FIG. 24 is a plan view of the adjusting mechanism of FIG. 23; and

DETAILED DESCRIPTION OF THE INVENTION

Figure 1:
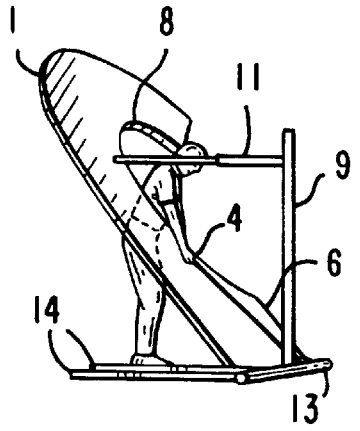
FIG. 1 is a front elevational view of the apparatus of the invention.
Figure 2:
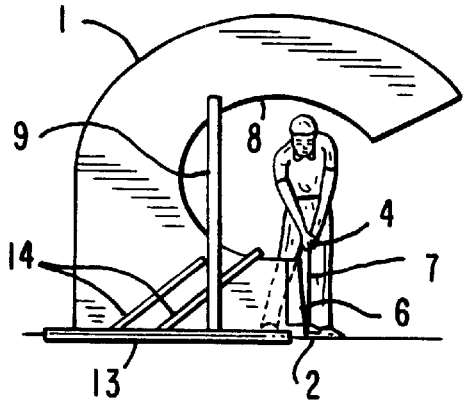
FIG. 2 is a side elevational view of the apparatus of the invention.

Referring to FIGS. 1 and 2, the apparatus of the invention includes but is not limited to a vertical post 10 which may be driven into the ground or otherwise supported by a suitable base 11 consisting of two lege 12, 13 attached to a horizontal pole 14. A rigid planar sheet, the inner surface of which establishes a "swing plane surface" is canted at an angle with the vertical. The precise angle may be adjusted by precisely adjusting the lengths of one or more of the guide wires, chains, telescopic mechanisms, or screw jacks to the post or rear support at one end, and to the planar sheet at the other end. As described hereinafter, the inclination of the sheet should have an approximate 10 degree relationship to the lie angle of the club being used. This is calibrated by addressing the golf ball and adjusting the planar surface until (1) the top of the shaft can lay comfortable flat under the "foam wedge" attached to the planar surface, and (2) it bisects the golfer's body in the area of the top of the golfer's spine. The inclination of the sheet is adjusted to be more upright for the shorter clubs, and less upright for the longer clubs. The wire(s), chains(s), or telescopic device may be marked or indexed to indicate lengths to be used for different clubs.

In accordance with the invention, an arcuate opening is formed in the front edge of the planar surface to permit a golfer to address the ball placed ahead of the plane with the head and neck portion of his/her body projecting through the "swing plane surface". In this manner, the golfer can address the ball and swing the clubhead along the swing plane inner surface of the sheet with the clubhead in sliding engagement with the surface. As will be understood, a golfer can gain awareness of what it is like to swing both back and forth on a singular plane of motion correctly, or align the base of the plane in different directions to induce alternative ball flights, under the tutelage of a golf professional or by himself/herself.

Figure 3:
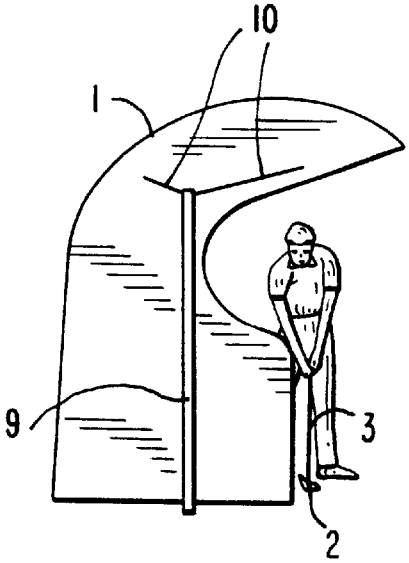
FIG. 3 and FIG. 4 are drawings showing the dimensions and shape for a first preferred embodiment of the swing plane surface.
Figure 4:
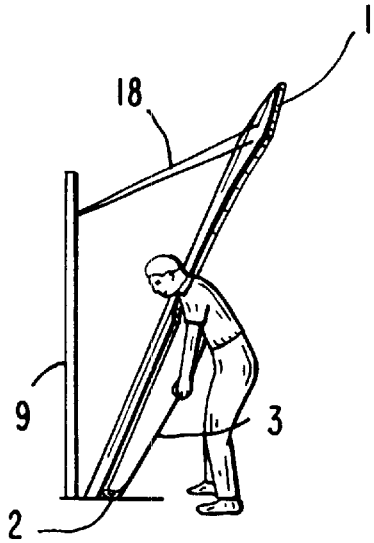

The dimensions and shape of a first preferred embodiment of the sheet are provided in FIGS. 3 and 4 and those of an alternative preferred embodiment are provided in FIG. 10.

The planar sheet may be plywood, Plexiglass (transparent or otherwise), or any lightweight but rigid sheet material. This planar sheet may be solid or perforated to reduce wind resistance and weight. Such a single element construction, while advantageous, may be replaced by a tubular metallic or tubular plastic frame in the general shape of the sheet having a lightweight fabric (coated for durability and to reduce friction) or plastic (transparent or otherwise) stretched across the frame and supported thereby. Alternatively, the planar sheet may be made in sheet segments hinged to one another so that the swing plane surface formed by the sheet is foldable and collapsible for ease of movement. Interior locking mechanisms may be employed so as to provide equally smooth surfaces on both sides. The post may be deployed as part of a portable tubular stand rather than driven into the ground. A single guide wire or chain rather than multiple wires or chains may be used, or an indexed screw mechanism or telescopic assembly may be deployed between the post and the sheet for precision, indexed adjustments.

The new apparatus uniquely delivers and controls the feel of swinging each club on its "ideal plane". It provides the golfer a unique perspective of what a fundamentally sound "on plane" swing feels like. Moreover, the plane of the apparatus may be readily adjusted to the "ideal swing plane" for clubs of different lengths.

Figure 16:
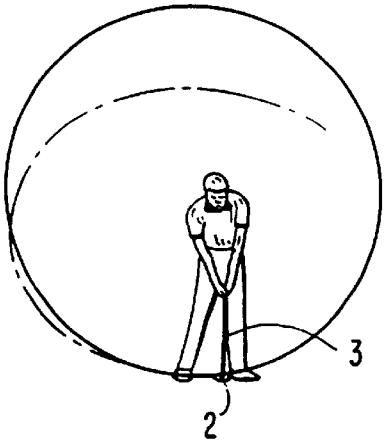
FIG. 16 is a schematic of the ideal swing circle.
Figure 17:
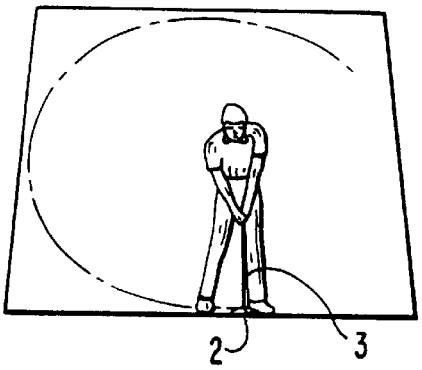
FIG. 17 is a schematic of the swing arc in the swing plane.

The arc that the clubhead inscribes as it is swung during an "ideal golf swing" as described in the literature and shown in the front elevational view of FIG. 16, would be perfectly congruent with a theoretical circle. The theoretical circle has the appearance of an ellipse in FIG. 16 because it is inclined from a 90 degree vertical upright plane. When viewed from the rear or "down the line" FIG. 17, the arc of the clubhead and the circumference of a theoretical circle superimposed upon it lay perfectly flat on a plane of the same inclination. It has been demonstrated by stop-action photography and computer analysis of the leading professional golfers that the arcs of their clubheads duplicate the theoretical circle lying within a flat inclined plane.

It has been determined that in the so-called "ideal golf swing" (what, in fact, the best players and ball-strikers in the world are doing), the arc of the clubhead, and not the clubshaft or hands, determines the plane of the swing, and this plane is always absolutely flat and unwavering. It is the prime objective of the new apparatus to train and make available to a golfer a means to learn and become aware of what it feels like to swing his/her clubhead on the ideal plane for the club in use, thereby approximating a swing along the theoretical circle.

Figure 5:
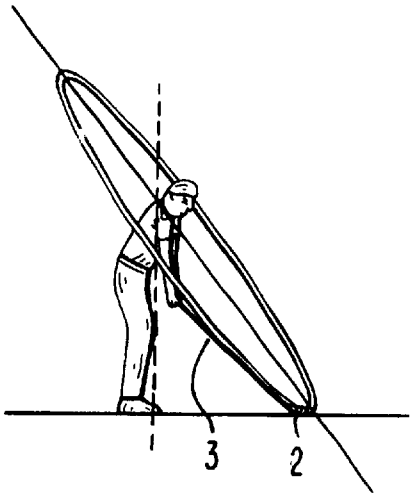
FIG. 5 is a schematic showing bisection of the back of the golfer's neck at the top of the spine by the ideal plane angle.
Figure 13:
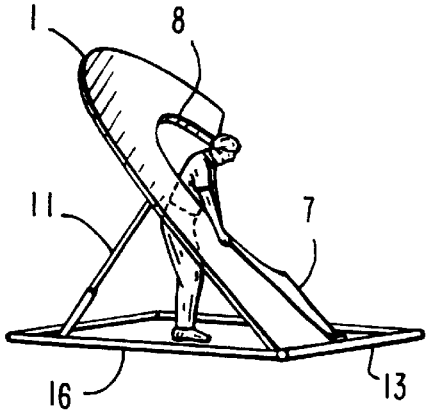
FIG. 13 shows a rear-supporting frame for the apparatus mounted on the side of the planar surface.
Figure 14:
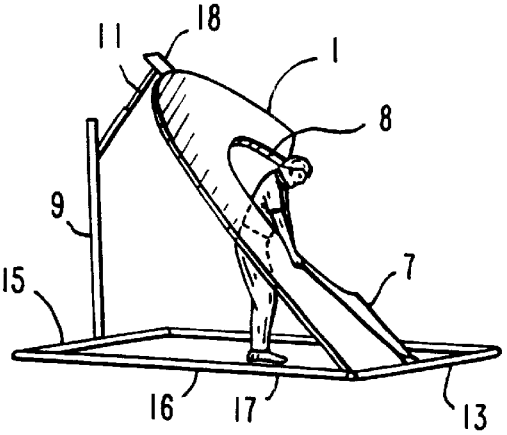
FIG. 14 shows a rear-supporting frame for the apparatus mounted on top of the planar surface.
Figure 15:
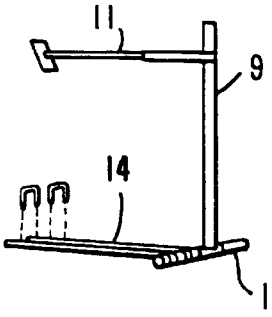
FIG. 15 shows ground stakes, which may be placed over supporting legs and driven into the ground for outdoor use and stability.

The new apparatus was developed to give the golfer the necessary feedback and reinforcement of muscle memory to determine if his/her clubhead is, in fact, swinging on the "ideal plane". It has been observed that this "ideal plane" bisects the golfer's body in the general area of the top of the spine at the back of the neck, as shown in FIG. 5.

Figure 7:
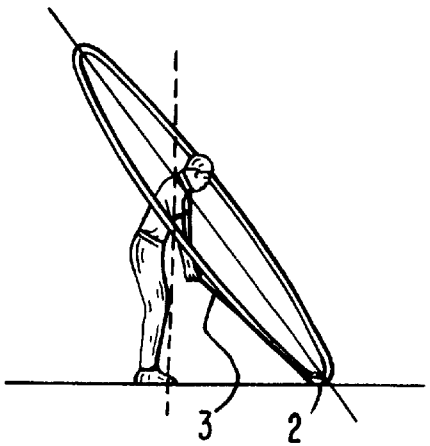
FIG. 7 is a schematic showing ideal plane angle for longer clubs.
Figure 6:
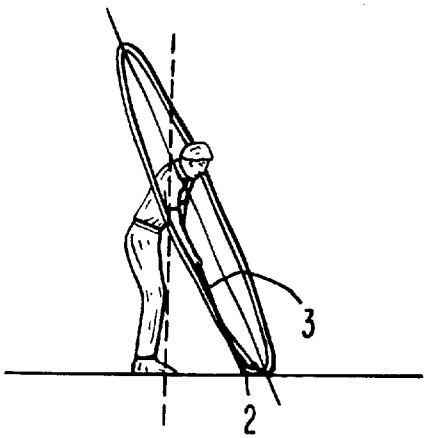
FIG. 6 is a schematic showing ideal plane angle for shorter clubs.

In using the apparatus of the invention, the lie angle of the clubshaft in use, plus 10 degrees, determines the specific plane angle, which is "flatter" and more inclined with the longer clubs, and "steeper" and more upright with the shorter clubs. However, the one other constant must be the point in which this plane bisects the golfer's body, FIGS. 6 and 7.

The apparatus of the invention gives the golfer the ability to set the plane angle to the proper inclination and alignment with each club so that it bisects the body in the proper location, and also has the correct 10 degree relationship to the clubshaft. Once the plane angle is set, by adjusting the length of the guide wire(s), chain(s), telescopic mechanism, or screw jack, deployed between the post and the sheet, the golfer then addresses the ball and swings the clubhead along the underside of the sheet, the ideal swing plane, maintaining the clubhead in contact with the sheet for the entire backswing.

At the top of the "proper backswing" (when clubshaft stops moving), the clubhead, the clubshaft, and the golfer's hands will all now be "on plane". The new apparatus provides the golfer tactile and visual feedback as to whether or not he/she is achieving this ideal position, and swinging the club "on plane".

As a backswing training aid alone, the new apparatus is unique in that it allows the golfer to correctly swing his/her clubhead up the underside of the golfer's "ideal plane" without the need for tracks, rails, or special clubs to restrict and limit motion. All other devices either track the clubshaft or guide the heel portion of the golf club. When training with the apparatus, the golfer's clubhead is simply either on or off his/her "ideal swing plane".

Ben Hogan, a world renowned ball-striker and professional golfer, taught and believed that "by staying on his backswing plane (ideal plane) the player pre-groups his forces so that each component is correctly geared to work with other components on the downswing . . . he can obtain maximum distance and accuracy." Hogan further believed that "for the golfer with a correct swing who pre-arranges his chain action by staying on his backswing plane and storing his power properly, golf is a tremendous pleasure. He reaps the full rewards for the effort he pours into it." (Ben Hogan's Five Lessons, The Modern Fundamentals of Golf, 1957). This is a further objective of the invention.

As a downswing training aid, the new apparatus will prevent a golfer from swinging "over the top" or on a downswing plane steeper than that of his backswing, because the golfer has swung the clubhead under and on the plane itself. This fault has plagued golfers since the beginning of the game as we know it. The only paths the golfer can take back to the golf ball (his downswing) when the backswing has been executed properly on the apparatus is on a "shallower angle than the backswing", or "on plane", which is what the best players of today are doing (FIG. 8). The golfer cannot go over plane, because his/her clubhead is under the planar surface (see FIG. 9). This is an important benefit of the new apparatus of the invention, because it helps to avoid the major fault in golf today, "swinging over the top".

In brief, while golf literature has been replete with disclosures and discussions of swing planes in general, and ideal swing planes in particular, a practical and simple training device to teach and reinforce proper backswing and downswing performance on a singular plane, and without the need for rails, guides, or shaft attachments has not been available to the golf industry and golf professionals. The unique training apparatus of the invention satisfies the need for such equipment.

The principles of the device shown in FIGS. 1–18 may be applied to training the putting stroke. it has been suggested that in a proper putting stroke, the putter head should swing or be swung on a path which is a straight back and straight through in relationship to the target line. It is also accepted that as the putting stroke gets longer, the arc of the putter head would naturally swing inside the target line in both the backswing and follow through.

The laws of physics dictate that when a pendulum is swung, it swings in a perfect arc, and this arc would be inscribed in a vertical plane of motion. It has been proven conclusively through analysis that a golf club when it is swung exhibits the same qualities as a pendulum unless the inertia of the motion is deflected. It has been established that the arc of the clubhead in a correct motion swings within an inclined plane of motion. The sole reason this motion is inclined is because of the design of the golf club and the fact that the shaft of the club is bored into the head on different angles off of the perpendicular.

The fact that putters are designed with different lie angles explains why some strokes swing on more vertical planes of motion than others.

The design of the present invention is unique in that it provided an adjustable planar surface 32 for the golfer to engage the toe of his/her putter to the underside while making a putting stroke. Since it has been established that the arc of the putter swings within a flat plane of motion, whether vertical or inclined, the present invention offers the golfer tactile feedback as to whether or not they are achieving such a motion.

the invention consists of two flat pieces, one which lies on the ground and serves as a counter balance 31 for the adjustable inclined surface 32 which is attached to it by two hinge mountings 33. The surface which is to be inclined has a flat lower leading edge 37 and a top which is carved into the shape of an arc 38. This top shape allows the golfer full view of the golf ball in all inclined positions of the device, as well as provides a visual representation of the desired arc. On top of this carved surface are reference numbers 36 in feet as to how far the golfer should swing his/her putter back and through on putts of different lengths. This strip with numbers 36 is removable, and a reverse application of the same numbers can be applied for left-handed golfers. Holes 35 are drilled in the inclined planar surface at different predetermined locations which correspond to both the right-handed and left-handed numbers so that cylindrical stop means 39 can be inserted to measure the length of stroke correctly, as an added aid in training his/her stance.

It is known that many putts are missed because the center of gravity of the putter is missed during the course of the stroke. This point of reference is commonly termed the "sweet spot" of the putter. Most putters include markings on the putter itself to accurately define this location. In application of the present invention, a simple slide out means "sweet spot locator bar" 34 is provided which is attached to the undersides of the counter balancing planar surface 31. On this piece is a slight indentation 40 for the golf ball to rest in. This means is to be adjusted so that when a ball is placed in it, the center of this ball would correspond to the pre-marked "sweet spot" location of each individual putter. When the toe of the putter is engaged to the inclined planar surface 32 and the ball is placed atop the sliding "sweet spot" locator bar" 34, 40, the golfer will be able to train through muscle memory the sensations of a proper stroke, while being assured that the "sweet spot" of the putter will be hit.

Other inventions attempt to track the putter head on a stroke straight away and then straight towards an intended target. This unnatural and manipulated motion for some does not allow the putter head to swing in a natural arc which would lay within an inclined plane of motion, and thus may contradict the design features of the putter in use or the ideal stroke of the individual. The present invention is unique in that it provides a planar surface 32 which can be adjusted to each individual and the unique characteristics of his/her putter, whether vertical or inclined.

The adjusting mechanism 41 which raises and lowers the adjustable planar surface 32 off of the vertical from the counter balancing plane 31 consists of but is not limited to a plate 45 with holes 44 spaced out in five degree increments which is attached to the counterbalancing plane 31 by a hinge 42. A pin 43 is attached to the adjustable planar surface 32 for the holes 44 of the adjusting mechanism 41 to slide over in 5 degree increments for the vertical 90° to a maximum inclination of 15° off of the vertical.

Figure 25:
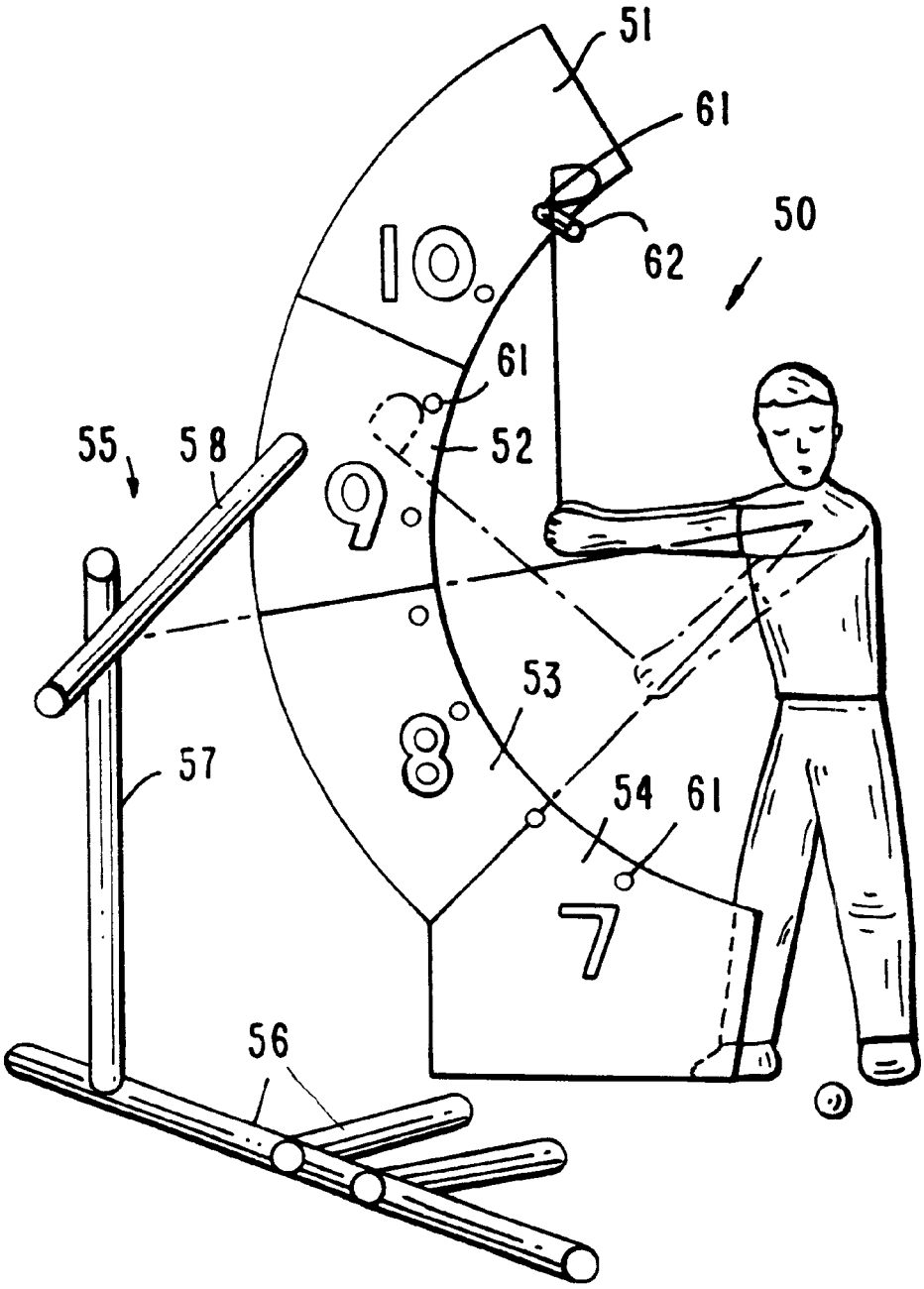
FIG. 25 is a perspective view of an alternate form of the apparatus of FIGS. 1–17, used for chipping and pitching stroke training.

The principles of the invention of the apparatus shown in FIGS. 1–18 may also be applied in a more compact apparatus, such as shown in FIG. 25, for the purposes of training a stroke having a less than full swing such as a chipping or pitching stroke. In the apparatus of FIG. 25, the clubhead guiding surface is a circular segment 50 comprised for four arc segments 51, 52, 53, 54 of 35° each (analogous to 6 o'clock to 11 o'clock on a clock face). The guiding surface is supported at an angle to vertical by a support system 55 comprised of horizontal member 56, vertoca; support arm 57, and adjusting arm 58, which may adjust the inclination of the surface 55 as required, e.g. 7° from vertical.

In use, the golfer takes the clubhead back along the planar inner surface of guide 55 to just short of 11 o'clock and returns on the plane to strike the ball. The smaller surface makes the apparatus of FIG. 25 more compact, more portable, and more readily adaptable for home use. A removable stop pin 62 may be inserted, if desired or necessary, in the guide surface in spaced apertures 61 to limit the golfer's backswing.

Although the foregoing description of the new and improved golf training apparatus of the invention has been given by way of several referred embodiments, it will be understood by those skilled in the art that other forms of the invention falling within the ambit of the following claims are contemplated. The adjusting mechanism may be a screw jack, or more rigid telescopic mechanism than the illustrated wires; the surface may be treated with silicone to make it more slippery, and it may be perforated to decrease weight and wind resistance, and to provide greater tactile feedback. The framing mechanism may be front or rear mounted with a supporting frame, platform, or legs and/or counterbalancing devices to provide stability. Sensors may be placed on the underside of the planar surface to provide auditory feedback to whether or not the clubhead is in contact. Accordingly, reference should be made to the following claims in determining the full scope of the invention.

I claim:

1. A golf training device for chipping, pitching, or putting comprising:

a) a vertical support means, b) an arcuate shaped rigid planar sheet having an outer and an inner surface and describing an arc of about 140°, c) an adjusting means engaging the arcuate shaped rigid planar sheet and holding said arcuate shaped rigid planar sheet in a predetermined angular relation with the vertical support, d) a removable stop insertable at predetermined locations along the arcuate shaped rigid planar sheet to limit movement of the golf club shaft, whereby a golfer may place the toe of the clubhead in contact with the inner surface of the arcuate sheet and may swing the golf club along the arc that is described by the inner plane of the arcuate sheet.

2. A golf training device for chipping, pitching, or putting comprising:

a) a vertical support means, b) an arcuate shaped rigid planar sheet having an outer and an inner surface describing an arc of about 140°, and consisting of four removable arc segments of about 35°, c) an adjusting means engaging the arcuate shaped rigid planar sheet and holding said arcuate shaped rigid planar sheet in a predetermined angular relation with the vertical support, whereby a golfer may place the toe of the clubhead in contact with the inner surface of the arcuate sheet and may swing the golf club along the arc that is described by the inner plane of the arcuate sheet.

* * * * *

UNITED STATES PATENT AND TRADEMARK OFFICE

CERTIFICATE OF CORRECTION

PATENT NO. : 6,582,319 B2
DATED : June 24, 2003
INVENTOR(S) : David Czaja

It is certified that error appears in the above-identified patent and that said Letters Patent is hereby corrected as shown below:

Title page,
Item [60], Related U.S. Application Data, please replace "Nov. 17, 2000." with -- Nov. 17, 2000, and pending U.S. Application No. 09/988,360 filed November 19, 2001. --

Column 7,
Line 42, please replace ". it" with -- . It --

Column 8,
Line 4, please replace "the" with -- The --
Line 36, please replace "locator bar"" with -- locator bar --

Signed and Sealed this

Seventh Day of October, 2003

JAMES E. ROGAN
*Director of the United States Patent and Trademark Office*